US005092505A

United States Patent [19]

Olschlager

[11] Patent Number: 5,092,505

[45] Date of Patent: Mar. 3, 1992

[54] SHOTGUN SLING APPARATUS

[76] Inventor: Doug. W. Olschlager, R.R. 1 Box 56, Manfred, N. Dak. 58465

[21] Appl. No.: 622,628

[22] Filed: Dec. 5, 1990

[51] Int. Cl.[5] ..... F41C 23/02; F41C 33/00

[52] U.S. Cl. ..... 224/150; 224/149; 224/913

[58] Field of Search ..... 224/150, 149, 913, 917, 224/901, 234, 242, 250, 251

[56] References Cited

U.S. PATENT DOCUMENTS

| | | | |
|---|---|---|---|
| 2,884,172 | 4/1959 | Kubo | 224/149 |
| 3,182,871 | 5/1965 | Gossler | 224/149 |
| 3,653,564 | 4/1972 | Carter | 224/150 |
| 4,094,441 | 7/1978 | Campbell | 224/150 |
| 4,531,661 | 7/1985 | Santy | 224/917 |

*Primary Examiner*—Henry J. Recla
*Assistant Examiner*—David J. Walczak
*Attorney, Agent, or Firm*—Leon Gilden

[57] ABSTRACT

An apparatus is set forth for permitting ease of transport of a shotgun by an individual to include an elongate central strap, with a rear pocket and a forward sleeve for mounting of the shotgun. A medial strap is provided mounted pivotally to the central strap for permitting rapid and convenient adjustment and securement of the associated firearm.

3 Claims, 4 Drawing Sheets

SHOTGUN SLING APPARATUS

BACKGROUND OF THE INVENTION

1. Field of the Invention

The field of invention relates to firearm slings, and more particularly pertains to a new and improved shotgun sling apparatus wherein the same is arranged for ease of mounting to an associated firearm.

2. Description of the Prior Art

Various firearm sling apparatus is provided in the prior art. These devices are normally arranged for permanent fixation to an associated rifle, as opposed to the instant invention which may be transported in a rolled configuration within a pocket of the like of an individual prior to its use and may be subsequently and rapidly mounted to an associated shotgun. Examples of the prior art include U.S. Pat. No. 4,331,271 wherein a waist strap is provided for circumferential mounting to an individual, with a further strap orthogonally mounted to the waist strap to include a plurality of spaced mounting clips for securement to support structure of an associated rifle.

U.S. Pat. No. 4,841,568 to Katsens sets forth a quickly detachable gun sling swivel construction arranged for repetity of securement to an associated swivel of an elongate firearm, such as a rifle.

U.S. Pat. No. 4,713,905 to Dupuy sets forth an elongate strap readily adjustable and includes a forward and rear sling swivel for mounting to swivel post structure of an associated firearm.

U.S. Pat. No. 3,869,074 to Roach sets forth a rifle holder arrangement wherein a butt loop receives a butt portion of a rifle, while a forward clip mounts the rifle in a diagonally oriented relationship across the chest of an individual for transport thereof.

U.S. Pat. No. 4,505,012 to Johnson sets forth a sling and swivel arrangement utilizing conventional forward and rear sling swivels for mounting to associated swivel eyes of an associated firearm.

As such, it may be appreciated that there continues to be a need for a new and improved shotgun sling apparatus as set forth by the instant invention which addresses both the problems of ease of use as well as convenience in mounting to an associated shotgun in a non-permanent relationship and in this respect, the present invention substantially fulfills this need.

SUMMARY OF THE INVENTION

In view of the foregoing disadvantages inherent in the known types of rifle sling apparatus now present in the prior art, the present invention provides a shotgun sling apparatus wherein the same provides for a unitary support structure readily transported by an individual when not in use and may be conveniently and quickly mounted to an associated shotgun during periods of transport of the shotgun organization. As such, the general purpose of the present invention, which will be described subsequently in greater detail, is to provide a new and improved shotgun sling apparatus which has all the advantages of the prior art rifle sling apparatus and none of the disadvantages.

To attain this, the present invention provides an apparatus permitting ease of transport of a firearm by an individual to include an elongate central strap, with a rear pocket and a forward sleeve for mounting of the shotgun. A medial strap is provided mounted pivotally to the central strap for permitting rapid and convenient adjustment and securement of the associated firearm.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shotgun sling apparatus which has all the advantages of the prior art shotgun sling apparatus and none of the disadvantages.

It is another object of the present invention to provide a new and improved shotgun sling apparatus which may be easily and efficiently manufactured and marketed.

It is a further object of the present invention to provide a new and improved shotgun sling apparatus which is of a durable and reliable construction.

An even further object of the present invention is to provide a new and improved shotgun sling apparatus which is susceptible of a low cost of manufacture with regard to both materials and labor, and which accordingly is then susceptible of low prices of sale to the consuming public, thereby making such shotgun sling apparatus economically available to the buying public.

Still yet another object of the present invention is to provide a new and improved shotgun sling apparatus which provides in the apparatuses and methods of the prior art some of the advantages thereof, while simultaneously overcoming some of the disadvantages normally associated therewith.

Still another object of the present invention is to provide a new and improved shotgun sling apparatus wherein the same is conveniently and quickly mounted to an associated shotgun or shotgun organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
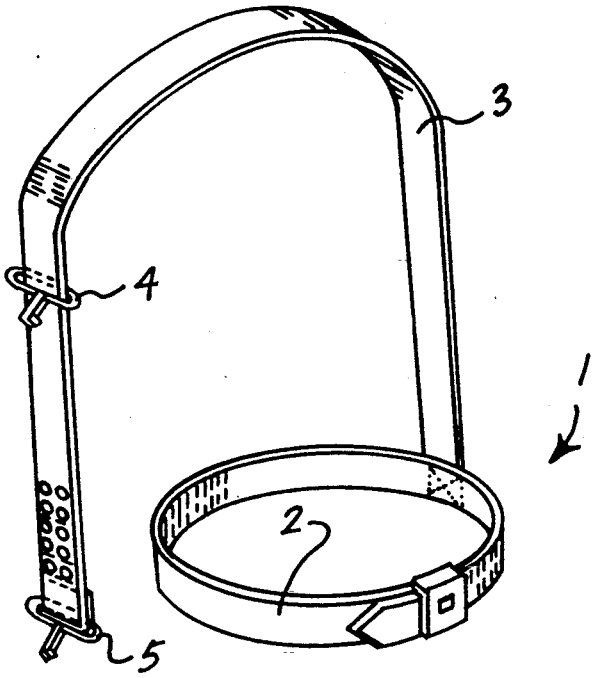
FIG. 1 is an isometric illustration of a prior art sling structure.
Figure 2:
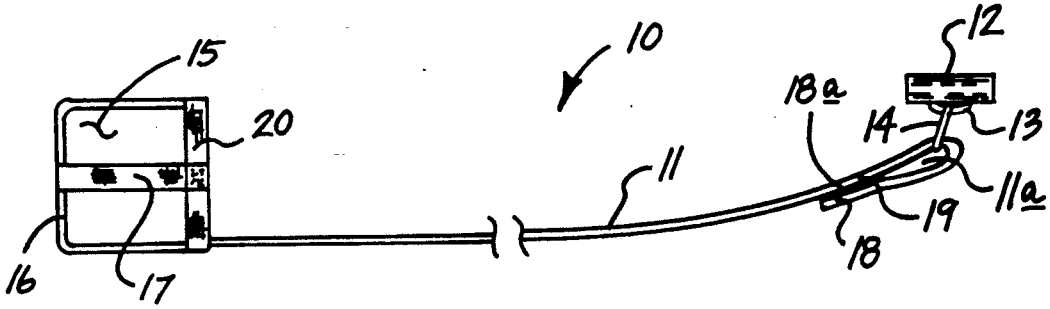
PRIOR ART FIG 2
FIG. 2 is an orthographic side view, taken in elevation, of the instant invention.
Figure 3:
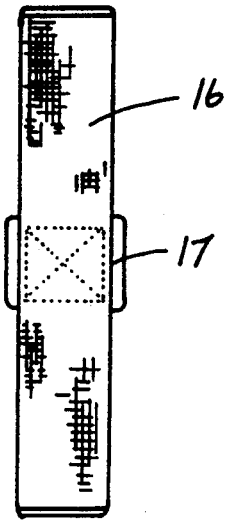
FIG. 3 is an orthographic rear view, taken in elevation, of the instant invention.

With reference now to the drawings, and in particular to FIGS. 2 to 8 thereof, a new and improved shotgun sling apparatus embodying the principles and concepts of the present invention and generally designated by the reference numeral 10 will be described.

FIG. 1 illustrates a prior art rifle sling apparatus 1, wherein a circumferential waist strap 2 is arranged for mounting about an individual, while a secondary strap 3 is orthogonally mounted at one end to the waist strap and its other end to the rifle utilizing spaced rear and forward swivel mounts 4 and 5 for mounting to associated rifle sling attachment hose of an associated firearm, as is conventionally utilized in the prior art and as illustrated in U.S. Pat. No. 4,331,271.

Figure 4:
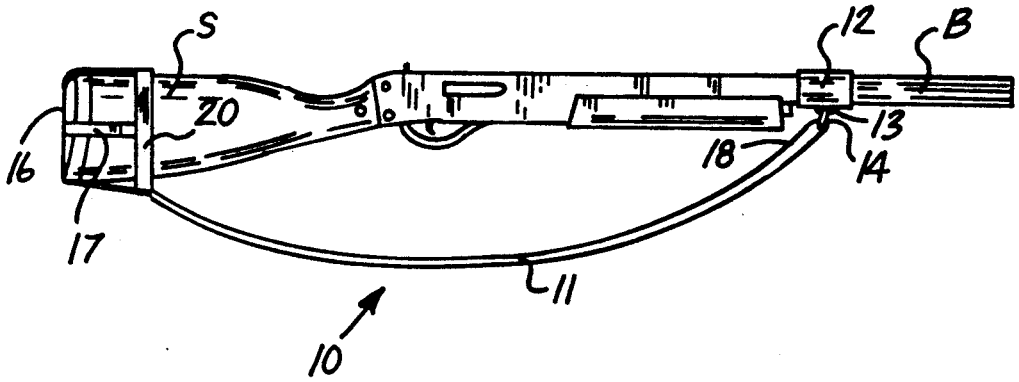
FIG. 4 is an orthographic side view of the instant invention mounted to an associated firearm.
Figure 5:
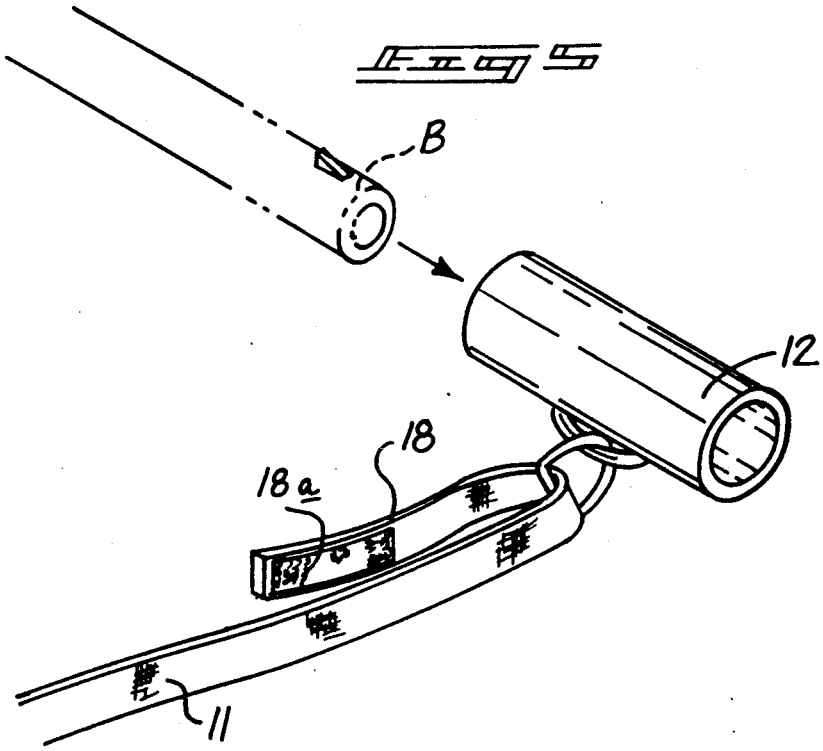
FIG. 5 is an isometric illustration of the forward support tube utilized by the instant invention and its relationship for securement overlying the firearm barrel.

More specifically, the rifle sling apparatus 10 of the instant invention essentially comprises an elongate flexible central strap 11, including a forward loop 11*a* formed at its forward end by a forward or first strap end 18 mounted to the body of the central elongate strap 11, including a first hook and loop fastener surface 18*a* mounted to a second hook and loop fastener surface 19 on the body of the central strap 11, wherein the second hook and loop fastener surface 19 is mounted on the central strap rearwardly of the forward terminal end of strap 11. The thusly formed forward loop 11*a* mounts a barrel support tube 12 formed of a flexible material that includes a first ring 13 mounted to the barrel support tube 12 and a second ring 14 mounting the first ring 13 to the forward loop 11*a*. A rear pocket 15 to receive the butt stock "S" therewithin is formed by a first "U" shaped strap 16 defined by the rear or second end of the elongate strap 11 formed in a "U" shaped configuration. A second "U" shaped strap 17 is mounted medially and orthogonally to the first "U" shaped strap 16. Each forward end of each "U" shaped strap is fixedly mounted to a continuous strap loop 20. The strap loop 20 is fixedly mounted to the central strap 11 at its lower terminal end, to the free end of the first "U" strap 16 at its upper terminal end, and to each side of the strap loop 20 are mounted the free ends of the second "U" shaped strap 17. FIG. 4 illustrates the barrel "B" received within the barrel support tube 12 and the butt stock "S" received within the rear pocket 15.

Figure 6:
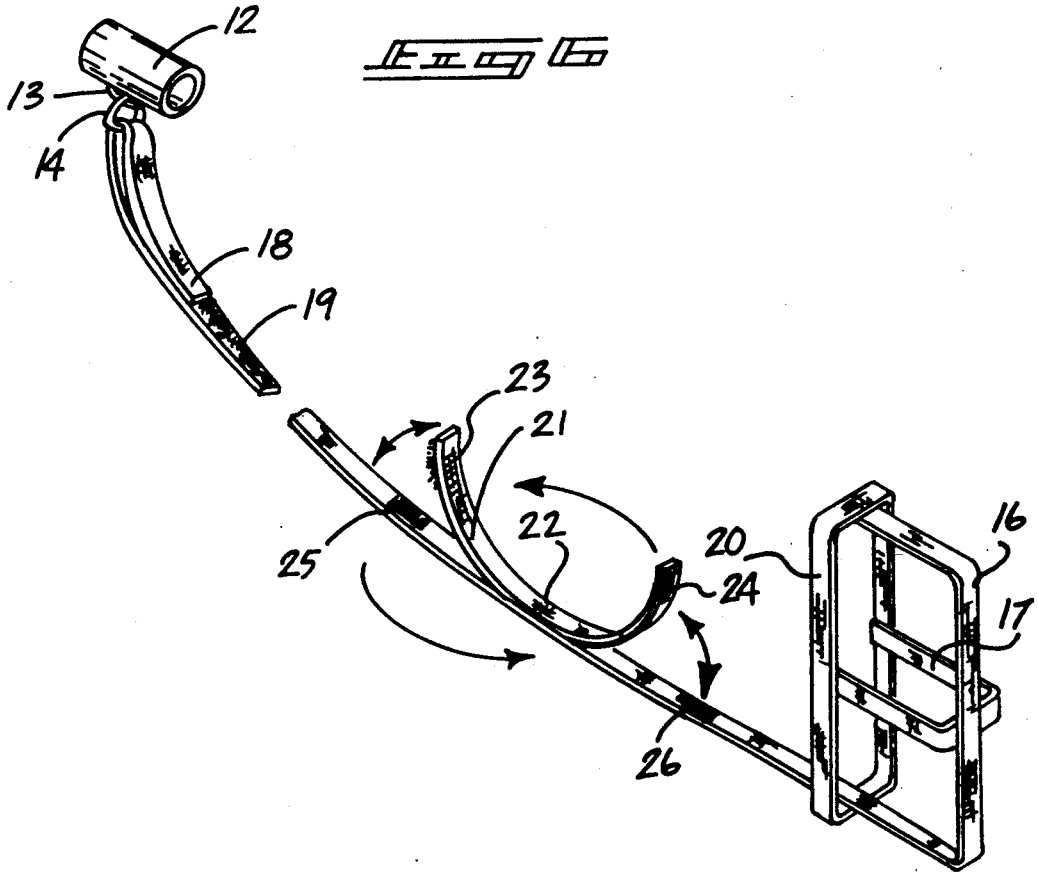
FIG. 6 is an isometric illustration of the instant invention utilizing a medial strap.
Figure 7:
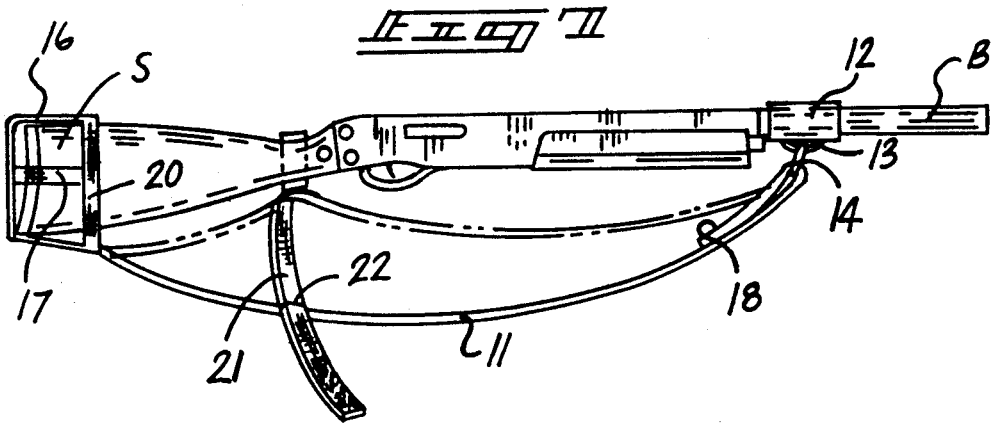
FIG. 7 is an orthographic side view of the instant invention utilizing the medial strap prior to mounting to an associated shotgun.
Figure 8:
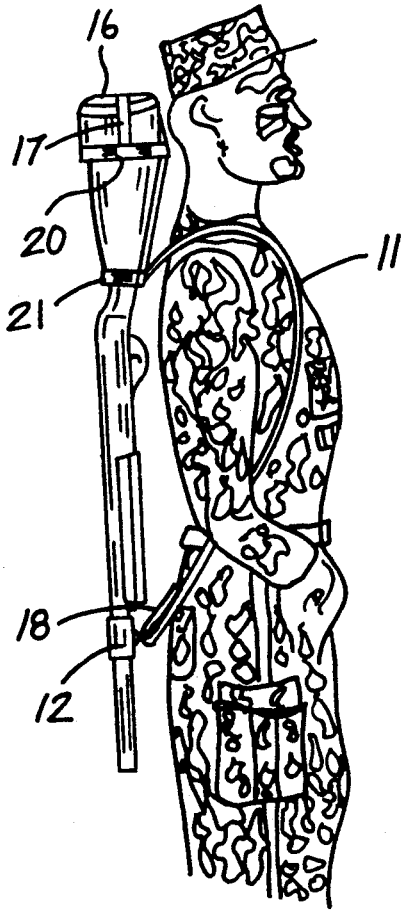
FIG. 8 is an orthographic side view of the organization and medial strap structure mounted to an associated shotgun.

FIG. 6 illustrates the use of a medial strap 21 mounted pivotally to the central strap 11 by a medial strap pivot 22 that is medially mounted to the medial strap 21. The medial strap 21 includes a third hook and loop fastener surface 23 and a respective fourth hook and loop fastener surface 24 mounted to bottom surfaces of the medial strap 21 at opposed terminal ends and are temporarily secured to respective fourth and fifth hook and loop fastener surfaces 25 and 26 formed at central strap 11 in a predetermined spacing substantially equal to the predetermined spacing between the third and fourth hook and loop fastener surfaces 23 and 24. In use, the medial strap 21 is disengaged from securement relative to the central strap 11 and is rotated and secured about the pistol grip portion of the butt stock "S" to enhance securement of the organization to an associated firearm for ease of transport and use to ensure that the rear pocket 15 remains mounted to the firearm.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rifle sling apparatus for securement to an associated firearm, wherein the firearm includes an elongate butt stock and a forward elongate barrel, the apparatus comprises, an elongate flexible central strap, the central strap including a forward terminal end, the forward terminal end including first securement means for securement of the forward terminal end to the central elongate strap defining a forward loop, and a barrel support tube mounted to the forward loop, and the central elongate strap including a rear terminal end defining a rear pocket, and wherein the barrel support tube is formed of a flexible material and includes a first ring mounted to the barrel support tube, and a second ring mounted to the first ring and to the forward loop, and wherein the first securement means includes a first hook and loop fastener surface mounted to the forward terminal end of the central strap, and a second hook and loop fastener surface mounted to the central elongate strap rearwardly of the forward terminal end, whereupon securement of the first hook and loop fastener surface to the second hook and loop fastener surface defines the forward loop, and wherein the rear pocket includes a first "U" shaped strap, and a second "U" shaped strap orthogonally and fixedly mounted medially of the first "U" shaped strap, and a continuous flexible loop mounted orthogonally to the first "U" shaped strap and the second "U" shaped strap at each free terminal end of the first "U" shaped strap and second "U" shaped strap, and wherein the continuous loop is orthogonally mounted to the central strap at a junction defined by the central strap and the first "U" shaped strap, and including a medial strap pivotally mounted to the central strap between the rear pocket and the forward loop.

2. An apparatus as set forth in claim 1 wherein the medial strap includes a pivot member mounting the medial strap to the central strap.

3. An apparatus as set forth in claim 2 wherein the medial strap includes a medial strap forward end and a medial strap rear end, and the medial strap forward end includes a third hook and loop fastener surface spaced from a fourth hook and loop fastener surface by a predetermined spacing, and a fifth hook and loop fastener surface mounted to the central strap underlying the third hook and loop fastener surface, and a sixth hook and loop fastener surface mounted to the central strap underlying the fourth hook and loop fastener surface, wherein the fifth and sixth hook and loop fastener surfaces are spaced apart by a predetermined spacing, and the medial strap is arranged for selective release from the central strap for securement to the pistol grip portion of the butt stock upon securement of the third hook and loop fastener surface to the fourth hook and loop fastener surface.

* * * * *